US009581383B2

(12) United States Patent
Brown et al.

(10) Patent No.: US 9,581,383 B2
(45) Date of Patent: Feb. 28, 2017

(54) REFRIGERATOR APPLIANCES

(71) Applicant: General Electric Company, Schenectady, NY (US)

(72) Inventors: Justin Tyler Brown, Louisville, KY (US); Stephen Bernard Froelicher, Shepherdsville, KY (US); Peter Hans Bensel, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 16 days.

(21) Appl. No.: 14/714,524

(22) Filed: May 18, 2015

(65) Prior Publication Data

US 2016/0341470 A1 Nov. 24, 2016

(51) Int. Cl.

| | |
|---|---|
| ***F21V 33/00*** | (2006.01) |
| ***F25D 27/00*** | (2006.01) |
| ***F25D 25/02*** | (2006.01) |

(52) U.S. Cl.

CPC ..... *F25D 27/00* (2013.01); *F21V 33/0044* (2013.01); *F25D 25/02* (2013.01)

(58) Field of Classification Search

CPC ..... F25D 27/00; F25D 25/02; F21V 33/0044

See application file for complete search history.

(56) References Cited

U.S. PATENT DOCUMENTS

| | | | | |
|---|---|---|---|---|
| 3,506,325 | A | 4/1970 | Horvay | |
| 5,690,415 | A * | 11/1997 | Krehl | A47F 5/101 108/23 |
| 2011/0164399 | A1 | 7/2011 | Driver et al. | |
| 2014/0140040 | A1 | 5/2014 | Giacomini et al. | |
| 2014/0265808 | A1* | 9/2014 | Kendall | F25D 27/00 312/408 |

* cited by examiner

*Primary Examiner* — Thomas M Sember

(74) *Attorney, Agent, or Firm* — Dority & Manning, P.A.

(57) ABSTRACT

A refrigerator appliance including a refrigerated chamber defined by a liner positioned within a cabinet is provided. At least one track extends generally along a vertical direction of the refrigerator appliance attached to or positioned adjacent to the liner. Additionally, a shelf assembly is configured to attach to the track. An electrical bar extends at least partially within the track and a probe of the shelf assembly is configured to extend into the track and press against the electrical bar along a transverse direction. The probe may accordingly make an electrical connection with electrical bar when the shelf assembly is attached the track.

20 Claims, 6 Drawing Sheets

REFRIGERATOR APPLIANCES

FIELD OF THE INVENTION

The present subject matter relates generally to refrigerator appliances, and more particularly to shelf lighting systems for refrigerator appliances.

BACKGROUND OF THE INVENTION

Refrigerator appliances generally include a cabinet that defines a chilled chamber for receipt of food items for storage. For example, the cabinet can define a fresh food chamber and a freezer chamber. The fresh food chamber can be maintained at a temperature greater than the freezing point of water. Conversely, the freezer chamber can be maintained at a temperature equal to or less than the freezing point of water.

Refrigerator appliances generally also include one or more shelf assemblies positioned within the fresh food chamber and/or the freezer chamber to facilitate storage and/or organization of any food items positioned therein. Typically, the shelf assemblies are adjustable in height using, e.g., a cantilevered track assembly. Accordingly, with such a configuration, the user may customize the fresh food chamber and/or the freezer chamber of the refrigerator appliance to meet their specific needs.

Modern refrigerator appliances can also include lighting systems attached to or embedded within the one or more shelf assemblies. The lighting systems can, e.g., illuminate the shelf assembly itself, or alternatively can illuminate a lower shelf assembly. However, in order for such refrigerator appliances to provide such lighting systems with electrical power, one or more electric wires are generally required to be disconnected and reconnected as the shelf assembly is adjusted. Certain consumers may find such electrical wires unsightly and may find the additional steps of disconnecting and reconnecting wires undesirable.

Accordingly, a refrigerator appliance having one or more shelf assemblies capable of connecting a lighting system to an electrical source without requiring disconnection and reconnection of electrical wires would be useful. Moreover, a refrigerator appliance having one or more shelf assemblies capable of connecting a lighting system to an electrical source without any visible connections would be particularly beneficial.

BRIEF DESCRIPTION OF THE INVENTION

Aspects and advantages of the invention will be set forth in part in the following description, or may be apparent from the description, or may be learned through practice of the invention.

In accordance with one embodiment, a refrigerator appliance is provided. The refrigerator appliance defines a vertical direction and a transverse direction. The refrigerator appliance includes a cabinet, a liner positioned within the cabinet defining a refrigerated chamber, and a track extending generally along the vertical direction. The track is attached to or positioned adjacent to the liner. The refrigerator appliance also includes an electrical bar extending at least partially within the track and a shelf assembly. The shelf assembly is configured for attachment to the track. The shelf assembly includes a probe configured to contact and exert a force on the electrical bar along the transverse direction when the shelf assembly is attached to the track such that the probe establishes an electrical connection with the electrical bar when the shelf assembly is attached to the track.

In accordance with another embodiment, a refrigerator appliance is provided. The refrigerator appliance defines a vertical direction and a transverse direction. The refrigerator appliance includes a cabinet, a liner positioned within the cabinet defining a refrigerated chamber, and a track. The track extends generally along the vertical direction and defines an internal cavity. The track is attached to or positioned adjacent to the liner. The refrigerator appliance also includes an electrical bar extending within the internal cavity of the track, and a shelf assembly. The shelf assembly includes a probe and is configured for attachment to the track. The probe extends into the internal cavity of the track and is configured to contact and exert a force on the electrical bar along the transverse direction when the shelf assembly is attached to the track. Accordingly, the probe electrically connects to the electrical bar when the shelf assembly is attached to the track.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
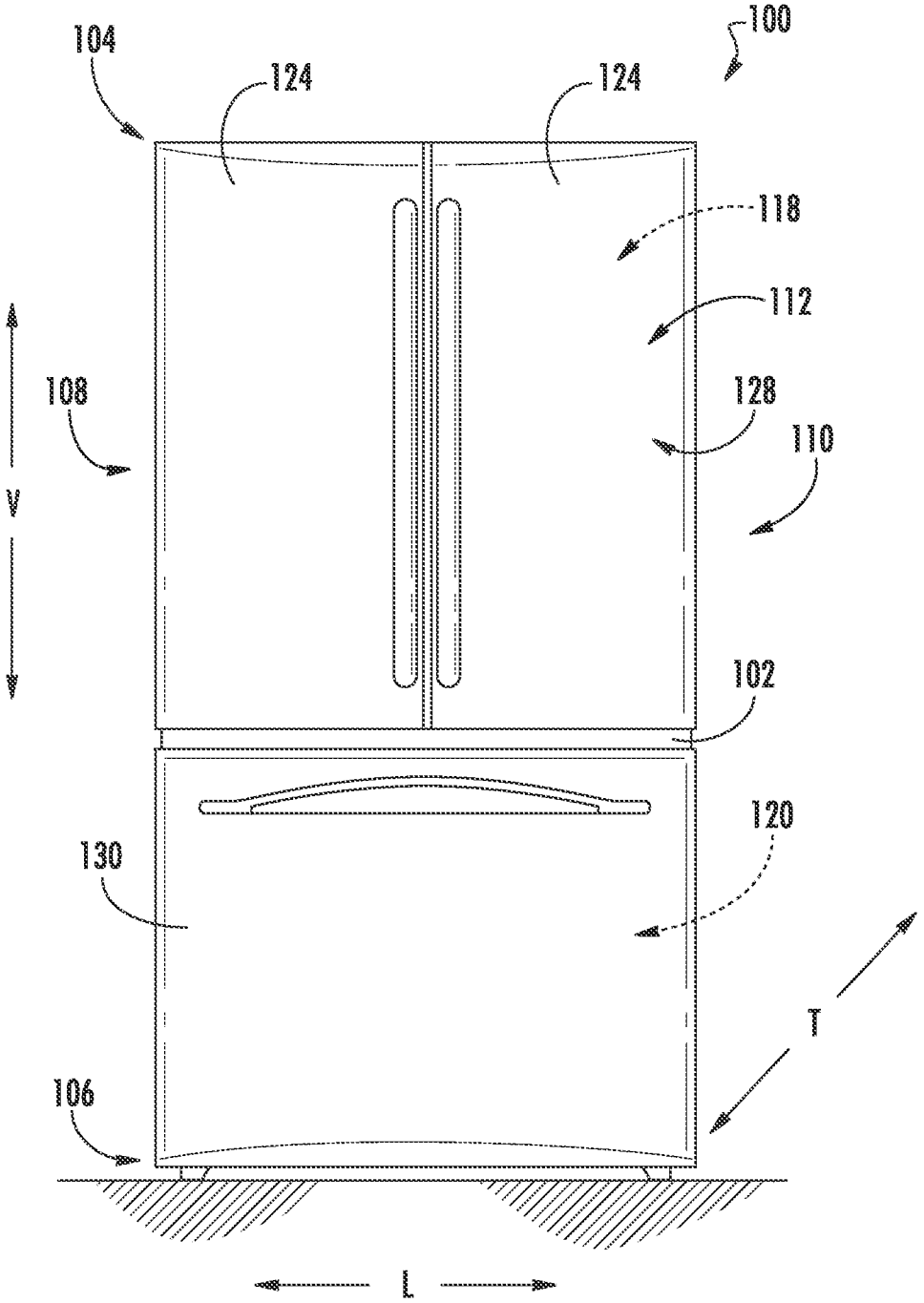
FIG. 1 provides a front, elevation view of a refrigerator appliance with doors in a closed position in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
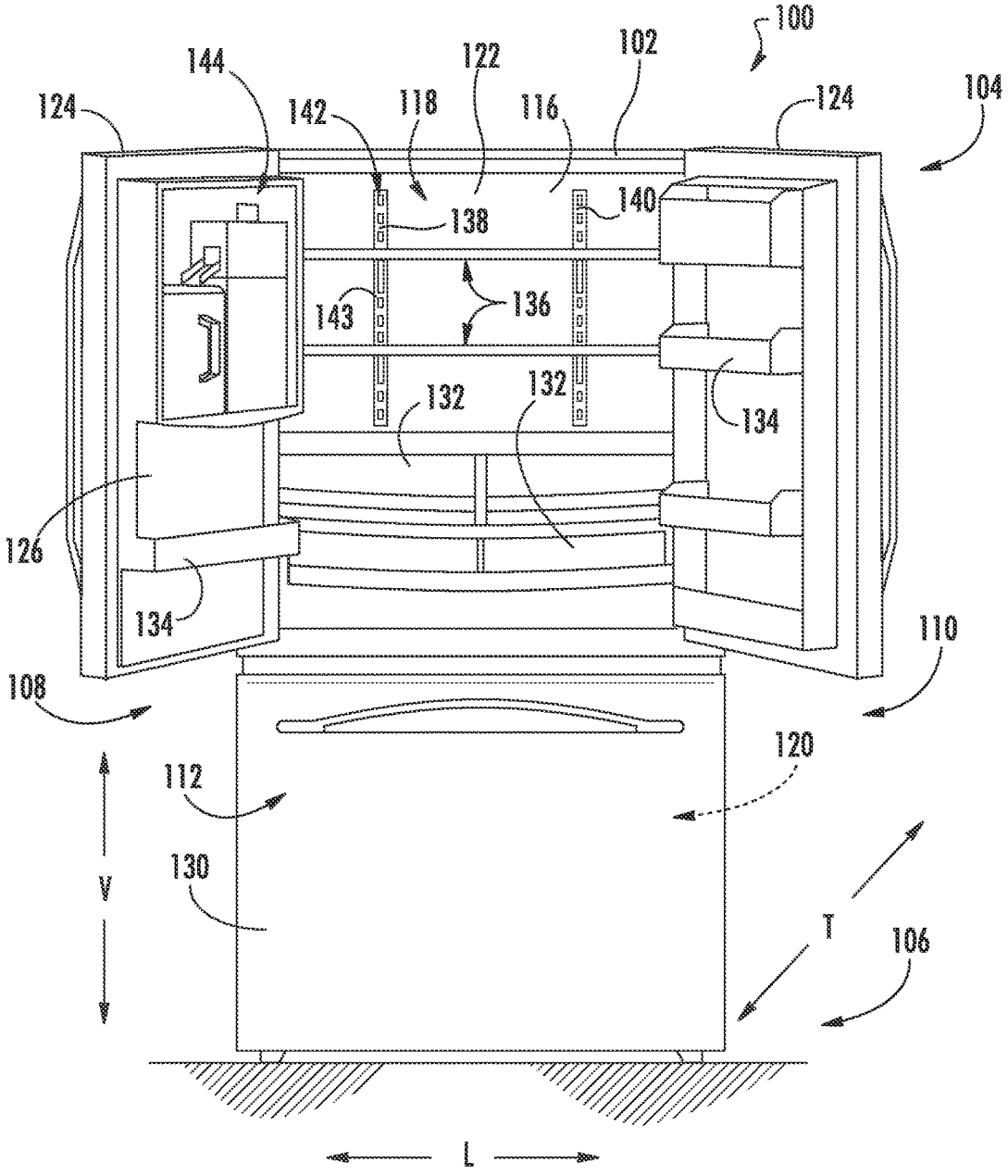
FIG. 2 provides a front, elevation view of the exemplary refrigerator appliance of FIG. 1 with doors of the refrigerator appliance shown in an open position.

FIG. 1 provides a front, elevation view of a refrigerator appliance 100 according to an exemplary embodiment of the present subject matter with refrigerator doors 124 of the refrigerator appliance 100 shown in a closed position. FIG. 2 provides a front, elevation view of refrigerator appliance 100 with refrigerator doors 124 shown in an open position to reveal a fresh food chamber 118 of refrigerator appliance 100.

Refrigerator appliance 100 includes a cabinet or housing 102 that extends between a top portion 104 and a bottom portion 106 along a vertical direction V, between a first side 108 and a second side 110 along a lateral direction L, and between a front side 112 and a rear side (not shown) along a transverse direction T. The vertical, lateral, and transverse directions V, L, T are each mutually perpendicular with one another. Cabinet 102 includes a liner 116 defining chilled chambers for receipt of food items for storage. In particular, as shown, liner 116 defines a fresh food chamber 118 positioned at or adjacent top portion 104 of cabinet 102 and a freezer chamber 120 arranged at or adjacent bottom portion 106 of cabinet 102. Fresh food chamber 118 is thus in these embodiments disposed above freezer chamber 120 along the vertical direction V. As such, refrigerator appliance 100 is generally referred to as a bottom mount refrigerator appliance 100. It is recognized, however, that the benefits of the present disclosure apply to other types and styles of refrigerator appliances such as, e.g., a top mount refrigerator appliance, a side-by-side style refrigerator appliance, a refrigerator only appliance (i.e, a refrigerator appliance not defining a freezer chamber 120), and/or a freezer only appliance (i.e., a refrigerator appliance not defining a fresh food chamber 118). Consequently, the description set forth herein is for illustrative purposes only and is not intended to be limiting in any aspect to any particular refrigerator configuration.

The liner 116 includes a plurality of walls at least partially defining the fresh food chamber 118 and freezer chamber 120. For example, the liner 116 includes a rear wall 122 positioned adjacent to the rear side of the refrigerator appliance 100, a first side wall (not shown) positioned adjacent to the first side 108 of the refrigerator appliance 100, and a second side wall (not shown) positioned adjacent to the second side 110 of the refrigerator appliance 100. One or more refrigerator doors 124 are rotatably mounted or hinged to an edge of cabinet 102 for selectively accessing fresh food chamber 118. The refrigerator doors 124 are spaced along the transverse direction T from the rear wall 122 of the liner 116. The refrigerator doors 124, along with the rear wall 122, first side wall, and second side wall of the liner 116, define the fresh food chamber 118. Each door 128 may include an inner surface 126 and an outer surface 128, between which the door 124 is generally defined. In addition, one or more freezer doors 130 are arranged below refrigerator doors 124 for selectively accessing freezer chamber 120. Freezer door 130 is coupled to a freezer drawer (not shown) slidably mounted within freezer chamber 120. As discussed above, refrigerator doors 124 and freezer door 130 are shown in the closed position in FIG. 1, and refrigerator doors 124 are shown in the open position in FIG. 2.

Referring now specifically to FIG. 2, various storage components are mounted within fresh food chamber 118 to facilitate storage and/or organization of food items therein. In particular, the storage components include drawers 132 that are mounted within fresh food chamber 118 and bins 134 mounted on doors 128. The bins 134 may be disposed within fresh food chamber 118 when the doors 128 are in the closed position. Additionally, as will be discussed in greater detail below, refrigerator appliance 100 includes one or more shelf assemblies 136 positioned within the fresh food chamber 118. Each of the shelf assemblies 136 are attached to one or more tracks extending generally along the vertical direction V attached to or positioned adjacent to the rear wall 122 of the liner 116. More particularly, the exemplary refrigerator appliance 100 depicted includes a first cantilevered track 138 and a second cantilevered track 140, each extending parallel to one another generally along the vertical direction V attached to the rear wall 122 of the liner 116. However, in other exemplary embodiments, any other suitable number of tracks may be provided. For example, in other exemplary embodiments, the refrigerator appliance 100 may include four tracks, with each shelf assembly 136 spanning between two tracks. With such an exemplary embodiment, the refrigerator appliance 100 may include two columns of shelf assemblies 136.

Referring still to FIG. 2, the first and second cantilevered tracks 138, 140 of the embodiment depicted each define a plurality of openings 142 evenly spaced along the vertical direction V in a front wall 143 of the respective track. As will be discussed below, the one or more shelf assemblies 136 are configured to attach to the first and second cantilevered tracks 138, 140 by having at least a portion interact with one or more of the openings 142 defined by the tracks 138, 140. Accordingly, for the embodiment depicted, the one or more shelf assemblies 136 are each configured as cantilevered shelf assemblies. Such a configuration may allow for the shelf assemblies 136 to be adjusted by a user of the refrigerator appliance 100 to customize the fresh food chamber 118 to their particular needs.

As may be seen in FIG. 2, an ice making assembly 144 is also included in refrigerator appliance 100. Ice making assembly 144 is depicted as being disposed within the fresh food chamber 118. However, in other exemplary embodiments, the ice making assembly 144 may alternatively be disposed within the freezer chamber 120 or a door 124, 130.

Figure 3:
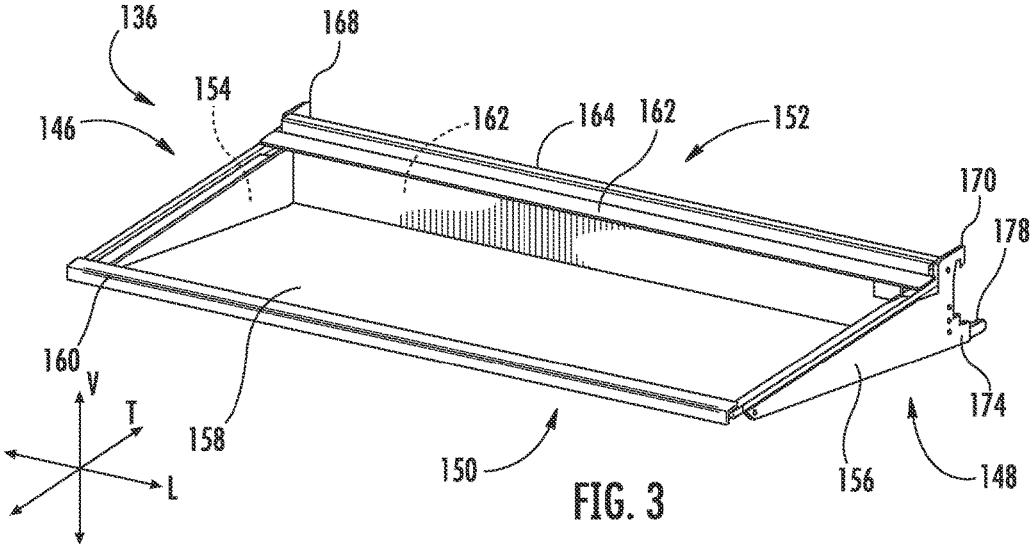
FIG. 3 provides a perspective view of a shelf assembly in accordance with an exemplary embodiment of the present disclosure.
Figure 4:
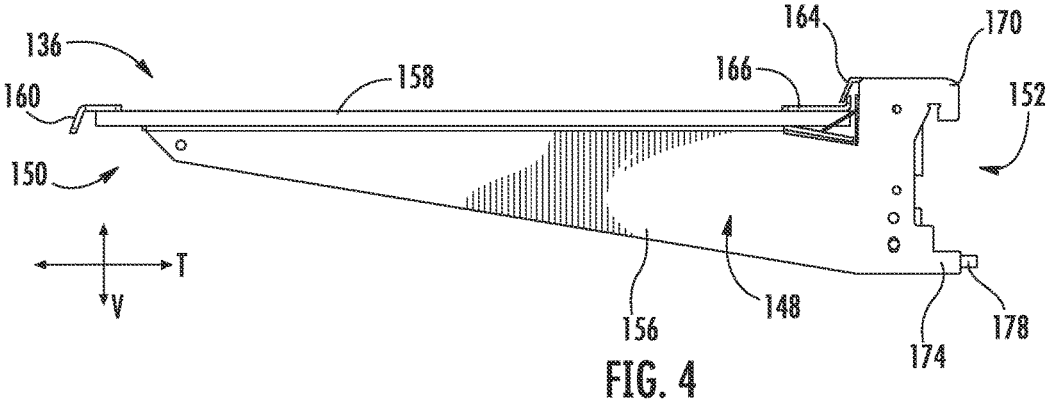
FIG. 4 provides a side view of the exemplary shelf assembly of FIG. 3.
Figure 5:
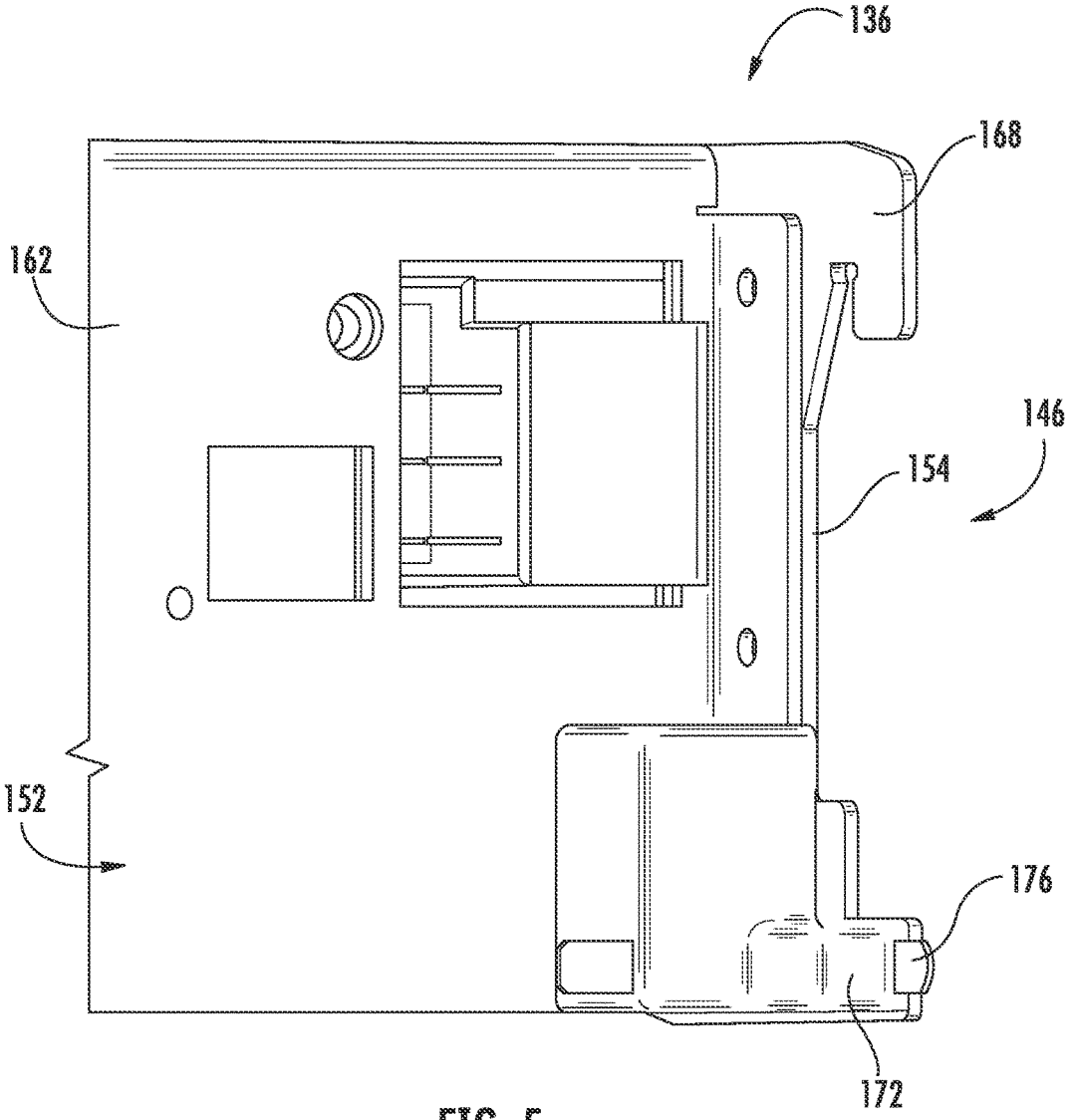
FIG. 5 provides a perspective view of a first side of the exemplary shelf assembly of FIG. 3, as viewed from a rear side of the exemplary shelf assembly.

Referring now to FIGS. 3 through 5, various views of a shelf assembly 136 in accordance with an exemplary embodiment present disclosure is provided. More particularly, FIG. 3 provides a perspective view of a shelf assembly 136 in accordance with an exemplary embodiment of the present disclosure; FIG. 4 provides a side view of the exemplary shelf assembly 136 of FIG. 3; and FIG. 5 provides a perspective view of a first side 146 of the exemplary shelf assembly 136 of FIG. 3 from a rear side 152.

The exemplary shelf assembly 136 extends along the lateral direction L between a first side 146 and a second side 148 and along the transverse direction T between a front side 150 and a rear side 152. Extending along the transverse direction T at the first side 146 and the second side 148 of the shelf assembly 136 are a first arm 154 and a second arm 156, respectively, configured to support shelf assembly 136. A transparent panel 158, which may in certain exemplary embodiments be a glass panel, extends along the lateral direction L between the first and second arms 154, 156. A cap 160 is positioned at the front side 150 of the shelf assembly 136, extending along the lateral direction L and covering a front edge of the transparent panel 158. At the rear side 152 of the shelf assembly 136, a support member 162 extends between and attaches to the first and second arms 154, 156. The support member 162 includes a lip 164 that extends over and forms a seal with a trim panel 166 positioned on the transparent panel 158 proximate to the rear side 152 of the shelf assembly 136. It should be appreciated, however, that the above described embodiment is provided by way of example only. In other exemplary embodiments, for example, the shelf assembly 136 may include a non-transparent panel. Additionally, one or more of the components described may be formed integrally together, or alternatively, one or more of the components described may be formed of a plurality of components joined in any suitable manner.

Referring still to FIGS. 3 through 5, the exemplary shelf assembly 136 is configured for attachment to a pair of tracks 138, 140 (see FIG. 2). In particular, the shelf assembly 136 includes a first attachment hook 168 positioned at the first side 146 of the shelf assembly 136 and a second attachment hook 170 positioned at the second side 148 of the shelf assembly 136. The first and second attachment hooks 168, 170 extend rearwardly generally along the transverse direction T at the rear side 152 of the shelf assembly 136. The first attachment hook 168 is configured to extend into one of the openings 142 in the first track 138 and the second attachment hook 170 is configured to extend into one of the openings 142 and the second track 140. Additionally, the shelf assembly 136 includes a first nub 172 positioned at the first side 146 of the shelf assembly 136 and a second nub 174 positioned at the second side 148 of the shelf assembly 136. The first nub 172 is spaced from the first attachment hook 168 along the vertical direction V and the second nub 174 is similarly spaced from the second attachment hook 170 along the vertical direction V. The first nub 172 is configured to extend into one of the openings 142 in the first track 138 below the opening into which the first attachment hook 168 is positioned. Additionally, the second nub 174 is configured to extend into one of the openings 142 in the second track 140 below the opening into which the second attachment hook 170 is positioned.

Further, for the embodiment depicted, the shelf assembly 136 additionally includes a first probe 176 extending through the first nub 172 and a second probe 178 extending to the second nub 174. The first nub 172 and first probe 176 extend rearwardly generally along the transverse direction T at the rear side 152 of the shelf assembly 136, and similarly the second nub 174 and second probe 178 also extend rearwardly generally along the transverse direction T at the rear side 152 of the shelf assembly 136. As will be discussed in greater detail below, the first and second probes 176, 178 are at least partially enclosed within the first and second nubs 172, 174, respectively, and are configured to make an electrical connection when the shelf assembly 136 is attached to the first and second tracks 138, 140.

For the embodiment depicted, the first attachment hook 168 and first nub 172 are each formed integrally with the first arm 154 and the second attachment hook 170 and second nub 174 are each formed integrally with the second arm 156. For example, the first and second arms 154, 156 may each be molded from a suitable plastic material. Notably, by forming the first and second nubs 172, 174 from a suitable plastic material, the nubs 172, 174 may act as an electrical insulator for the probes 176, 178. The opening in the first and second nubs 172, 174 through which the first and second probes 176, 178, respectively, extend may be formed during the molding of the first and second arms 154, 156, or alternatively may be formed separately using, e.g., a drilling or extrusion process. It should be appreciated, however, that in other exemplary embodiments, the first and second attachment hooks 168, 170 and first and second nubs 172, 174 may instead be formed separately from first and second arms 154, 156 using any suitable method. Additionally, in other exemplary embodiments, one or more of the first and second arms 154, 156, the first and second attachment hooks 168, 170, and the first and second nubs 172, 174 be formed of any other suitable material, such as a metal material. However, should one or both of the first and second nubs 172, 174 be formed of an electrically conductive material, an electrical insulation layer may be provided between the first and second probes 176, 178 and the first and second nubs 172, 174, respectively.

Figure 6:
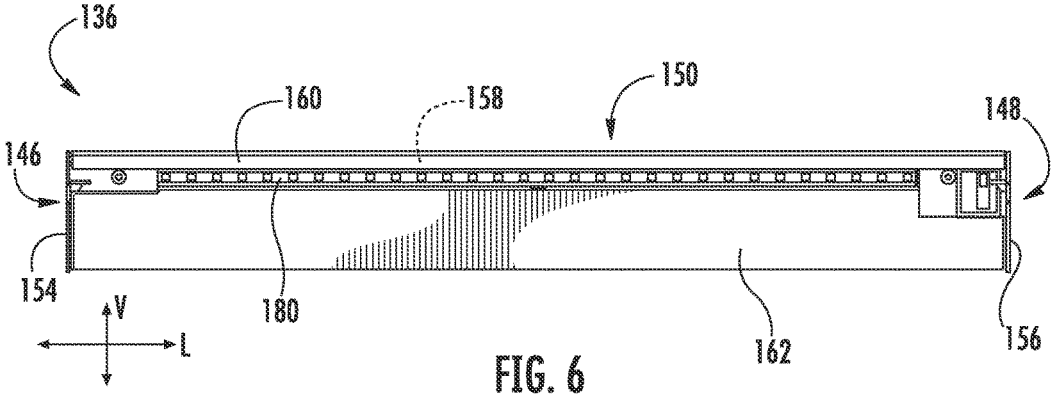
FIG. 6 provides a front view of the exemplary shelf assembly of FIG. 3.

Referring now also to FIG. 6, a front view of the exemplary shelf assembly 136 of FIG. 3 is provided. For the exemplary shelf assembly 136 depicted, a light source 180 is attached to the shelf assembly 136 for, e.g., illuminating a portion of a fresh food chamber 118 of the refrigerator appliance 100 when activated. The light source 180 is in electrical communication with the first probe 176 and the second probe 178, such that the first and second probes 176, 178 may provide electric power to the light source 180. For the embodiment depicted, the light source 180 is a strip of LEDs attached to the support member 162 immediately beneath transparent panel 158. With such a configuration, the light source 180 may illuminate the transparent panel 158 when activated. Additionally, with such a configuration, the light source 180 may also illuminate at least a portion of a lower shelf assembly 136. Notably, by being positioned on the support member 162 immediately beneath the transparent panel 158, the light source 180 may be generally hidden from view from a user during normal operation. It should be appreciated, however, that in other exemplary embodiments, any other suitable light source 180 may be provided, such as a halogen light source, an incandescent light source, etc. Additionally, in other exemplary embodiments the light source 180 may additionally or alternatively be positioned in any other suitable location. For example, in other exemplary embodiments, the light source 180 may be attached to an inside surface of one or both of the first arm 154 and second arm 156.

Figure 7:
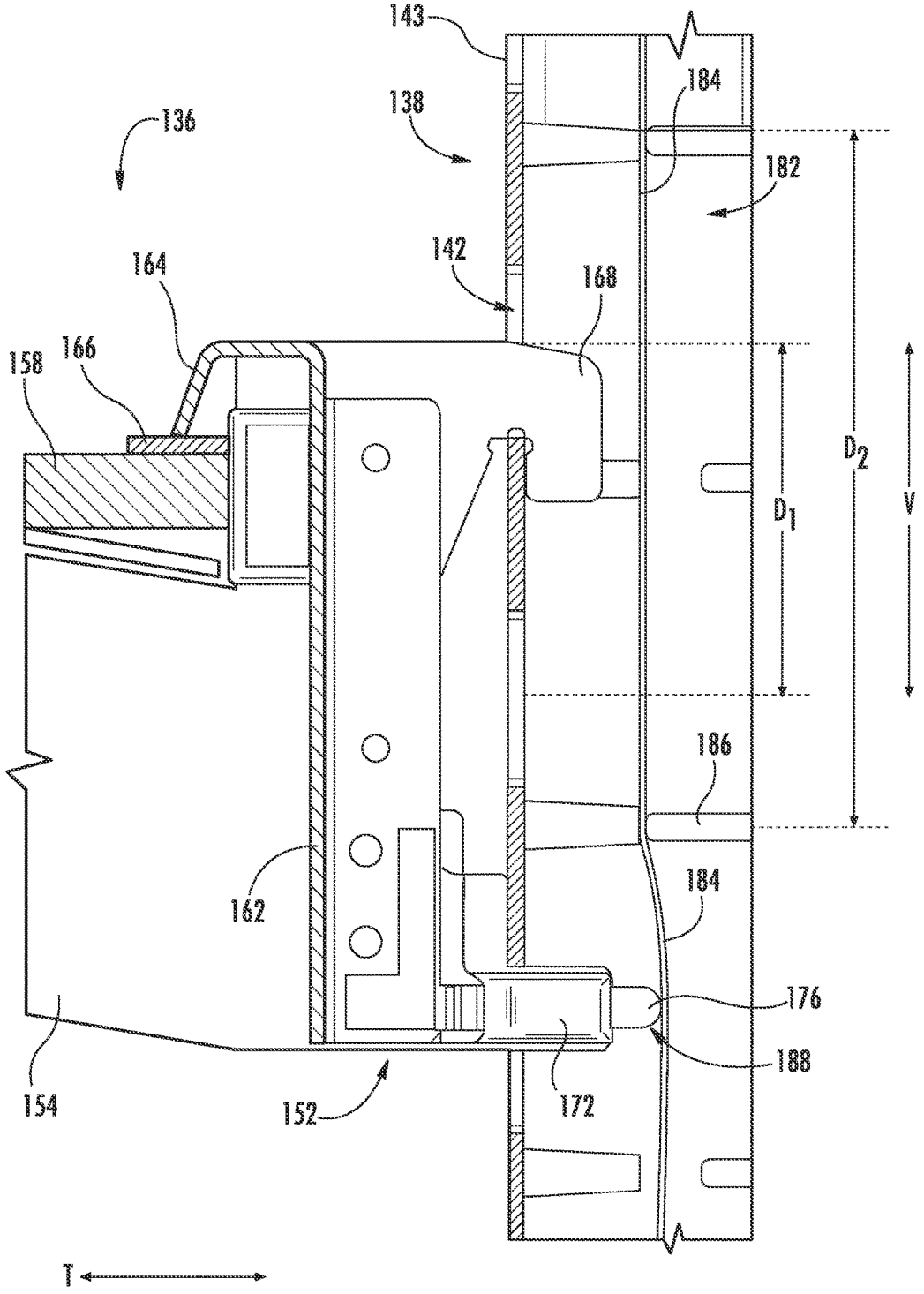
FIG. 7 provides a side, cross-sectional view of the exemplary shelf assembly of FIG. 3 installed in a track of the exemplary refrigerator appliance of FIG. 1.
Figure 8:
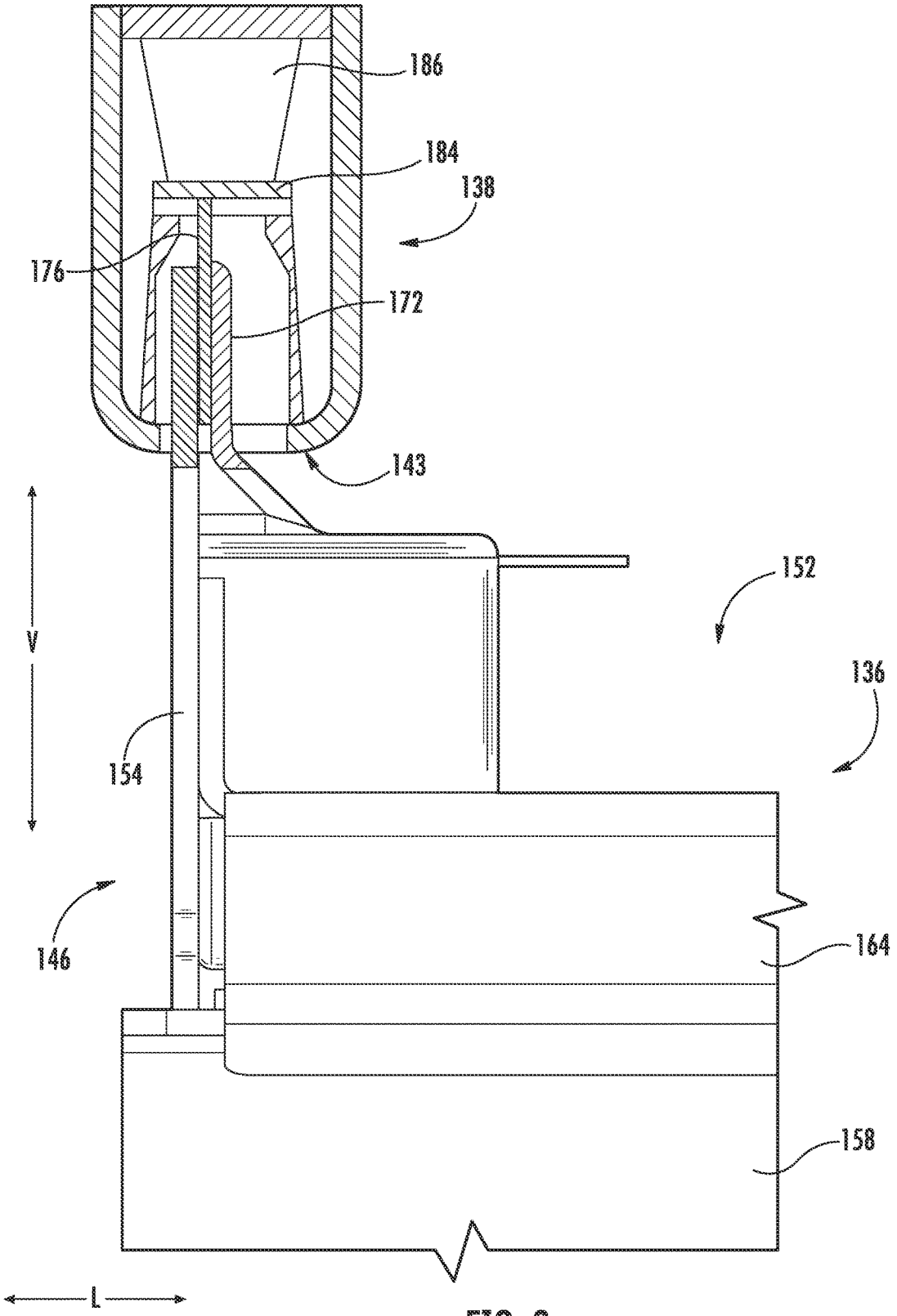
FIG. 8 provides a top, cross-sectional view of the exemplary shelf assembly of FIG. 3 installed in the track of the exemplary refrigerator appliance of FIG. 1.

Reference will now be made to FIGS. 7 and 8. FIG. 7 provides a side, cross-sectional view of the first side 146 of the exemplary shelf assembly 136 of FIG. 3 attached to the first track 138; and FIG. 8 provides a top, cross-sectional view of the exemplary shelf assembly 136 of FIG. 3 attached to the first track 138.

As shown, the first track 138 defines an internal cavity 182. At least partially within the internal cavity 182, a first electrical bar 184 is provided extending generally along the vertical direction V. Notably, for the exemplary embodiment depicted, the first electrical bar 184 extends within the internal cavity 182 of the first track 138 such that the first probe 176 may make an electrical connection with the first electrical bar 184 when the shelf assembly 136 is attached to the first track 138. Additionally, for the embodiment depicted, the first electrical bar 184 is configured as a low aspect ratio bar (i.e., a relatively low ratio of width to length) as viewed in a plane defined by the lateral direction L and the transverse direction T. For example, in certain exemplary aspects, the first electrical bar 184 may have an aspect ratio of less than or equal to about 0.2. It should be appreciated, that as used herein, terms of approximation, such as "about" or "approximately," refer to being within a ten percent margin of error.

Additionally, it should be appreciated that although not depicted, the refrigerator appliance 100 additionally includes a second electrical bar extending within, or at least partially within, an internal cavity defined by the second track 140 such that the second probe 178 may also make an electrical connection with the second electrical bar when the shelf assembly is 136 attached to the second track 140. In certain exemplary embodiments, the first electrical bar 184 may be positively charged the second electrical bar may be negatively charged to provide the requisite electrical power through the first and second probes 176, 178 to the light source 180 attached to the shelf assembly 136.

The first electrical bar 184 is supported within the internal cavity 182 of the first track 138 by a plurality of supports 186. For the embodiment depicted, the plurality of supports 186 extend generally along the transverse direction T and attach to a rear side of the first electrical bar 184. Each of the plurality of supports 186 are evenly spaced along the vertical direction V. Similarly, each of the openings 142 in the first track 138 are also evenly spaced on the vertical direction V. More particularly, each adjacent opening in the plurality of openings 142 is separated by a first separation distance $D_1$ along the vertical direction V. Additionally, each support in the plurality of supports 186 are separated by a second separation distance $D_2$ along the vertical direction V. For the embodiment depicted, the second separation distance $D_2$ is approximately twice as long as the first separation distance $D_1$. Further, each support 186 is separated from the nearest opening 142 in the track 138 along the vertical direction V by about one third of the first separation distance $D_1$. Accordingly, with such a configuration, each support 186 is approximately one third of the first separation distance $D_1$ away from the nearest opening 142 along the vertical direction V and approximately two thirds of the first separation distance $D_1$ away from an adjacent opening 142 along the vertical direction V. Such a configuration may ensure a proper amount of normal force is exerted on the first electrical bar 184 by the first probe 176. As used herein, the first separation distance $D_1$ refers to a distance measured along the vertical direction V from a center of one opening 142 to a center of an adjacent opening 142. Similarly, as used herein, the second separation distance $D_2$ refers to a distance measured along the vertical direction V from a center of where one support 186 is attached to the first electrical bar 184 to a center of where and adjacent support 186 is attached to the first electrical bar 184.

Notably, as is shown as clearly in FIG. 7, when the shelf assembly 136 is attached to the first track 138, the first probe 176 contacts and exerts a force (i.e., a normal force) on the electrical bar 184 along the transverse direction T. With such a configuration, the first probe 176 may establish an electrical connection with the first electrical bar 184 positioned within the internal cavity 182 of the first track 138 when the shelf assembly 136 is attached to the first track 138. Moreover, such a configuration may ensure a desired electrical connection between the first probe 176 and the first electrical bar 184 is formed when the shelf assembly 136 is attached to the first track 138. For example, with such a configuration, the shelf assembly 136 may utilize its weight and its cantilevered configuration with the first track 138 to exert a relatively large amount of normal force of the first electrical bar 184 with the probe 176. Further, in certain exemplary embodiments, the first probe 176 and the first electrical bar 184 may be formed of a stainless steel material. Such a configuration may ensure the first probe 176 and first electrical bar 184 are capable of withstanding such an amount of normal force for proper electrical connection between the first probe 176 and first electrical bar 184. For example, by forming the first probe 176 and first electrical bar 184 of a stainless steel material, the components may be capable of withstanding an amount of normal force necessary for, e.g., pressing through an oxide layer which may form on one or both of the first probe 176 and first electrical bar 184 over time.

Further, in order to assist in making the desired electrical connection between the first probe 176 and first electrical bar 184, a distal end 188 of the first probe 176 defines a semicircular shape in a plane defined by the vertical direction V and transverse direction T (see FIG. 7). Accordingly, the distal end 188 of the first probe 176 may allow for a greater contact surface area with the first electrical bar 184, thus improving an electrical connection between the two components.

It should be appreciated that the second probe 178 and second electrical bar may be configured in substantially the same manner as the first probe 176 and first electrical bar 184. For example, the second electrical bar may be supported within the second track 140 by plurality of supports, which may extend generally along the transverse direction T. The plurality of openings 142 in the second track 140 may be evenly spaced a first separation distance apart from one another. Similarly, each of the supports supporting the second electrical bar within the second track 140 may be evenly spaced a second separation distance apart from one another. The second separation distance may be approximately twice as long as the first separation distance along the vertical direction V. Moreover, as with the supports 186 supporting the first electrical bar 184 within the first track 138, the supports supporting the second electrical bar with a second track 140 may be separated from the openings 142 by approximately one third of the first separation distance.

A refrigerator appliance 100 having such a configuration may provide a more desirable shelf assembly 136 configuration. More particularly, a refrigerator appliance 100 having such a configuration may allow for the shelf assembly 136 to be moved or rearranged within the fresh food chamber 118 without requiring the disconnection and/or reconnection of one or more electric wires. Additionally, a refrigerator appliance 100 having such a configuration may allow for providing electrical power to a substantially concealed light source 180 using components substantially concealed within the shelf assembly 136, such that the user may not see any unsightly and/or undesirable wires or electrical connection means.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction and a transverse direction, the refrigerator appliance comprising:

a cabinet;

a liner positioned within the cabinet defining a refrigerated chamber;

a track extending generally along the vertical direction attached to or positioned adjacent to the liner;

an electrical bar extending at least partially within the track; and a shelf assembly configured for attachment to the track, the shelf assembly including a probe configured to contact and exert a force on the electrical bar along the transverse direction when the shelf assembly is attached to the track such that the probe establishes an electrical connection with the electrical bar when the shelf assembly is attached to the track, and wherein the probe deforms the electrical bar when the shelf assembly is attached to the track.

2. The refrigerator appliance of claim 1, further comprising a light source attached to the shelf assembly, the light source in electrical communication with the probe of the shelf assembly.

3. The refrigerator appliance of claim 1, wherein the shelf assembly includes an attachment hook spaced from the probe along the vertical direction, wherein the probe and the attachment hook each extend rearwardly along the transverse direction, and wherein the track is a cantilevered track defining a plurality of openings spaced along the vertical direction, each opening configured for receipt of the attachment hook or the probe.

4. The refrigerator appliance of claim 1, wherein the refrigerator appliance also defines a lateral direction, wherein the probe is a first probe positioned at a first side of the shelf assembly along the lateral direction, wherein the shelf assembly further includes a second probe positioned a second side of the shelf assembly along the lateral direction.

5. The refrigerator appliance of claim 4, wherein the track is a first track and the electrical bar is a first electrical bar, and wherein the refrigerator appliance further includes a second track attached to or positioned adjacent to the liner and spaced from the first track along the lateral direction; and a second electrical bar extending at least partially within the second track, wherein the second probe is configured for electrical attachment to the second electrical bar when the shelf assembly is attached to the second track.

6. The refrigerator appliance of claim 5, wherein the first electrical bar is positively charged, and wherein the second electrical bar is negatively charged.

7. The refrigerator appliance of claim 1, wherein the track defines an internal cavity, and wherein the electrical bar is supported within the internal cavity of the track by a plurality of supports.

8. The refrigerator appliance of claim 7, wherein the track defines a plurality of openings evenly spaced along the vertical direction, wherein each adjacent opening in the plurality of openings is separated by a first separation distance, and wherein each adjacent support in the plurality of supports are separated by a second separation distance, wherein the second separation distance is about twice as long as the first separation distance.

9. The refrigerator appliance of claim 8, wherein each support is separated from the nearest opening in the track along the vertical direction by about one third of the first separation distance.

10. The refrigerator appliance of claim 1, wherein the refrigerator appliance also defines a lateral direction, wherein the shelf assembly includes an attachment hook spaced from the probe along the vertical direction and aligned along the lateral direction, and wherein the track defines a plurality of openings spaced along the vertical direction and aligned along the lateral direction, each opening configured for receipt of the attachment hook or the probe.

11. The refrigerator appliance of claim 1, wherein the probe and the electrical bar are comprised of stainless steel.

12. A refrigerator appliance defining a vertical direction, a lateral direction, and a transverse direction, the refrigerator appliance comprising:

a cabinet;

a liner positioned within the cabinet defining a refrigerated chamber;

a track extending generally along the vertical direction and defining an internal cavity, the track attached to or positioned adjacent to the liner;

an electrical bar extending within the internal cavity of the track; and a shelf assembly including a probe and an attachment hook spaced from one another along the vertical direction and aligned along the lateral direction, the shelf assembly configured for attachment to the track, the probe extending into the internal cavity of the track and configured to contact and exert a force on the electrical bar along the transverse direction when the shelf assembly is attached to the track such that the probe electrically connects to the electrical bar when the shelf assembly is attached to the track.

13. The refrigerator appliance of claim 12, further comprising a light source attached to the shelf assembly, the light source in electrical communication with the probe of the shelf assembly.

14. The refrigerator appliance of claim 12, wherein the probe and the attachment hook each extend rearwardly along the transverse direction, and wherein the track is a cantilevered track defining a plurality of openings spaced along the vertical direction, each opening configured for receipt of the attachment hook or the probe.

15. The refrigerator appliance of claim 12, wherein the refrigerator appliance also defines a lateral direction, wherein the probe is a first probe positioned at a first side of the shelf assembly along the lateral direction, wherein the shelf assembly further includes a second probe positioned a second side of the shelf assembly along the lateral direction.

16. The refrigerator appliance of claim 15, wherein the track is a first track and the electrical bar is a first electrical bar, and wherein the refrigerator appliance further includes a second track attached to or positioned adjacent to the liner and spaced from the first track along the lateral direction, the second track also defining an internal cavity; and a second electrical bar extending within the internal cavity of second track, wherein the second probe is configured for electrical attachment to the second electrical bar when the shelf assembly is attached to the second track.

17. The refrigerator appliance of claim 12, wherein the electrical bar is supported within the internal cavity of the track by a plurality of supports.

18. The refrigerator appliance of claim 17, wherein the track defines a plurality of openings evenly spaced along the vertical direction, wherein each adjacent opening in the plurality of openings is separated by a first separation distance, and wherein each adjacent support in the plurality of supports are separated by a second separation distance, wherein the second separation distance is about twice as long as the first separation distance.

19. The refrigerator appliance of claim 18, wherein each support is separated from the nearest opening in the track along the vertical direction by about one third of the first separation distance.

20. The refrigerator appliance of claim 12, wherein the probe contacts and deforms the electrical bar when the shelf assembly is attached to the track.

* * * * *